US005805195A

United States Patent [19]

Smither et al.

[11] Patent Number: 5,805,195

[45] Date of Patent: Sep. 8, 1998

[54] DIODE-LESS THERMAL PRINT HEAD AND METHOD OF CONTROLLING SAME

[75] Inventors: Miles A. Smither, Friendswood; Naven C. Ho, Missouri City, both of Tex.

[73] Assignee: Oyo Instruments, Inc., Houston, Tex.

[21] Appl. No.: 621,910

[22] Filed: Mar. 26, 1996

[51] Int. Cl.[6] ..... B41J 3/20; B41J 2/335

[52] U.S. Cl. ..... 347/211

[58] Field of Search ..... 347/211

[56] References Cited

U.S. PATENT DOCUMENTS 4,032,925 6/1977 Kos ..... 347/211
4,477,820 10/1984 Moriguchi et al. ..... 347/211
4,668,962 5/1987 Stallkamp ..... 347/209
4,737,800 4/1988 Caillol et al. ..... 347/211
5,444,475 8/1995 Mitani ..... 347/200

*Primary Examiner*—Stuart N. Hecker
*Attorney, Agent, or Firm*—Fulbright & Jaworski L.L.P.

[57] ABSTRACT

The present invention provides a method and apparatus that selectively connects a voltage source to a plurality of groups of resistive printing elements, arranged substantially in a single row, in a thermal print head. The power available at printing elements selected to print is greater than that available at printing elements not selected to print.

18 Claims, 4 Drawing Sheets

DIODE-LESS THERMAL PRINT HEAD AND METHOD OF CONTROLLING SAME

BACKGROUND OF THE INVENTION

A. Field of the Invention

This invention relates to a thermal print head for a thermal printer. More particularly, this invention relates to a diode-less thermal print head for use in a thermal printer.

B. Discussion of the Related Technology

Thermal print heads (TPHs) are used in a wide array of electronic printing applications. In general, to print, a thermally sensitive print medium, such as thermal film or paper, passes between a thermal print head and a printer platen on a thermal printer. The individual resistive printing elements, or nibs, arranged on the thermal print head are selectively controlled to conduct current, or not. Nibs selected to conduct current heat up rapidly, causing the thermal print medium in close proximity to the nib to darken. Thermal printing is accomplished in this manner. Generally, the higher the nib density, the higher the printing quality and definition.

The first TPHs utilized discrete wiring for the individual connections for each nib. As the number of nibs increase, this approach becomes unwieldy because of the number of wires involved. An electronic solution is to place a shift register inside the TPH. The data corresponding to the individual nibs is serially entered into the shift register, requiring only data and clock lines. Associated with each bit in the shift register is an electronic current sinking switch on the output tap of the shift register to connect a particular nib to ground, such that if the stored bit is a 'one' the switch is on and the nib is connected to ground, and if the stored bit is a 'zero' the switch is off and current does not flow through the nib.

Each shift register switch controls one terminal of an individual nib. The other nib terminal is accessed through a power bus common to all the nibs. After all the data is loaded into the shift register to select which nibs are to be turned on, the power bus common to all nibs is powered momentarily to provide power to the nibs connected to the bus, which causes the selected nibs, which have been grounded by the shift register switch, to heat up.

As nib density is increased further, a two phase nib control circuit is commonly used. In the two phase method, the nibs are divided into two groups, A and B. The nibs are typically placed in a row as follows:

ABABABABABABABABAB . . .

FIG. 1 illustrates the two phase approach for a 16 nib TPH. The shift register/switch combination is indicated by the switches S1 through S8. The shift register is shared between the two nib group phases. In operation, data for Phase A nibs is loaded into the shift register and the Phase A common bus is powered by a voltage source, $V_A$, to heat the selected Phase A nibs. Data for Phase B nibs is then loaded into the shift register and the Phase B common bus is powered by a voltage source, $V_B$, to heat the selected Phase B nibs. Using this approach, diodes I1*a*–I8*b* are used to prevent cross-talk between the two nib phases. The diodes, however, are problematic since one diode is required for each nib and the diodes are typically discrete and are not incorporated into the shift register/switch integrated circuit. For a TPH having N nibs, the diodes add 2N connections, thereby increasing the cost of the TPH.

Thus, a need exists for a thermal print head having increased nib density to perform high contrast printing for graphic arts and other applications, without being limited in cost and design by use of discrete diodes.

SUMMARY OF THE INVENTION

The present invention is for a method of selectively heating individual resistive printing elements, or nibs, substantially arranged in a single row on a thermal print head (TPH) without the use of diodes. By being able to selectively control the flow of current to a particular nib, without cross-talk and without using diodes, the nib density can be increased and the cost of the TPH reduced.

Two voltage sources are selectively connected to a first and a second group, or phase, of nibs in a TPH. The nibs from the two groups are arranged to form the pattern ABABABABABABA . . . . The magnitude of the voltage from the first voltage source is about three times that of the second voltage source. Thus, the power available to nibs selectively connected to the first voltage source is about nine times that available to nibs selectively connected to the second voltage source. Because of this 9 to 1 power ratio, resistive heating of the nibs connected to the higher voltage source will occur, and will be minimal for nibs connected to the lower voltage source.

In this manner, selective nib heating occurs, causing printing on a thermal print medium, without the use of diodes to prevent cross-talk between the two groups, or phases, of nibs.

DETAILED DESCRIPTION OF THE PREFERRED EMBODIMENT

Figure 1:
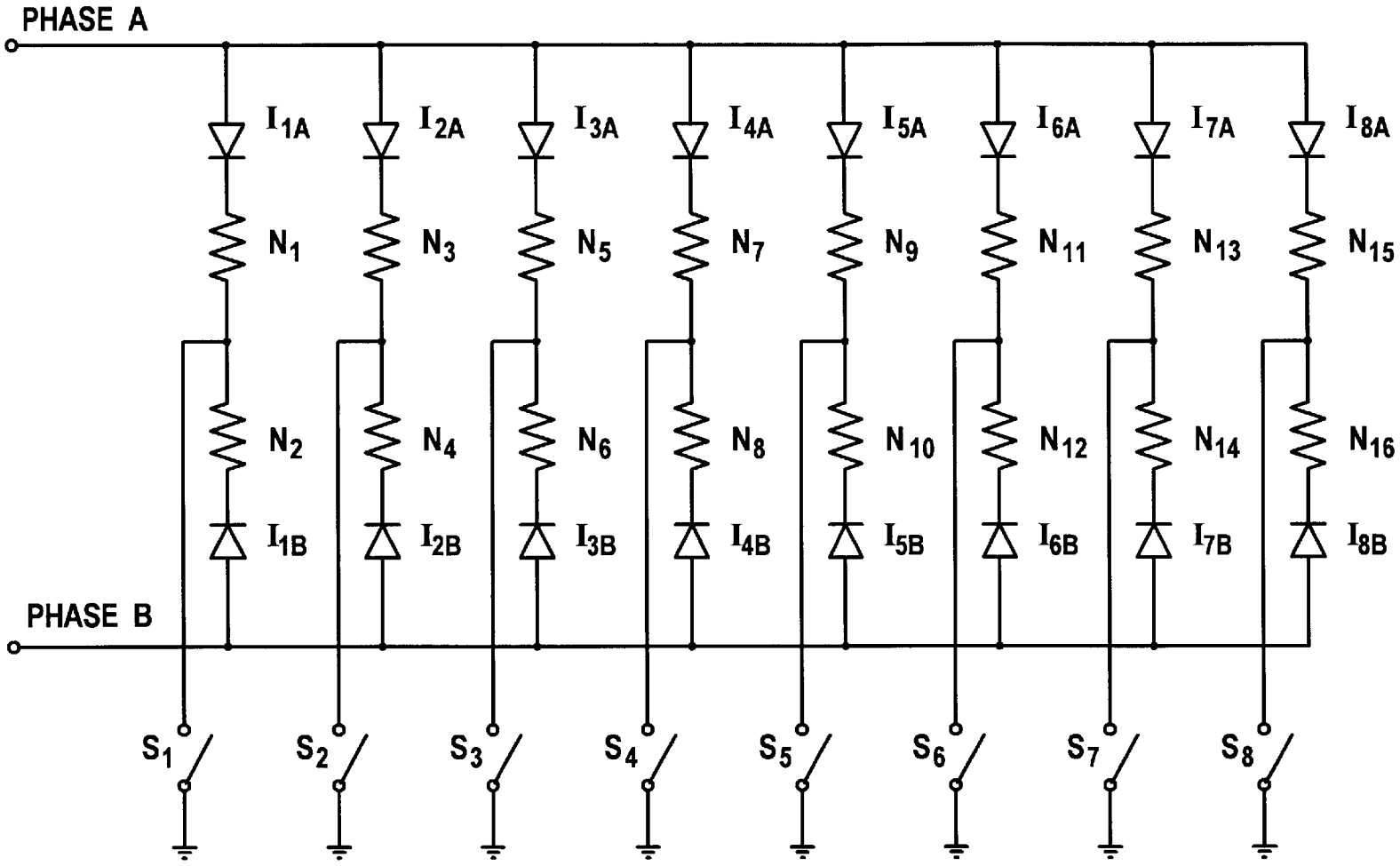
FIGURE 1 (PRIOR ART)
FIG. 1 is a schematic diagram of a TPH, with diodes, of the prior art.
Figure 2:
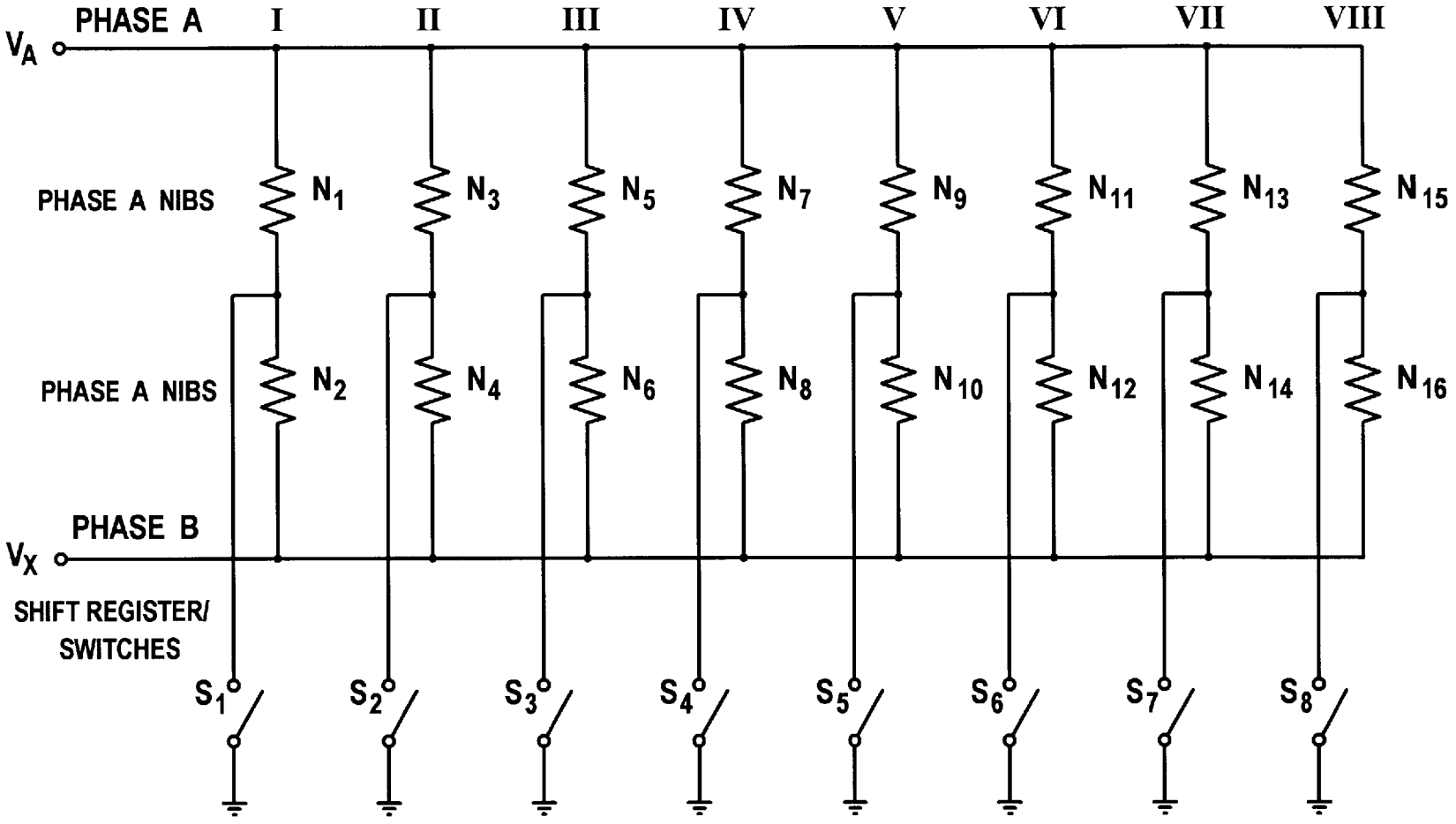
FIG. 2 is a schematic diagram of a TPH having no diodes.

As discussed above and as illustrated in FIG. 1, the use of diodes in the prior art in a two phase TPH adds significantly to the cost. Diodes have been traditionally used to prevent cross-talk between the two nib phases, or groups, of thermal printing elements, or nibs N1–N16. FIG. 2 illustrates the problem. Assume current sinking switch S1, which is typically the output tap of a shift register (not shown) and is thereby programmable, is ON and all other current sinking switches, S2–S8, which are also programmable, are OFF. When Phase A nibs, N1, N3, N5, N7, N9, N11, N13 and N15, are powered with Va volts, the Phase A nib N1 associated with switch S1 in nib set I is powered with $Va^2/R$ watts of power. If Phase B is left disconnected, the Phase B nib N2 associated with switch S1 will be powered through the remaining seven nib sets II–VIII. Thus, the Phase B nib N2 associated with switch S1 will be powered by $[Va/(R+2R/7)]^2 \times R$ Watts.

In general, for a TPH having N nibs, the OFF nib in the selected nib set will be powered by $[Va/(R+2R/(N/2)-1))]^2 \times R$ Watts, or, as N gets large, by $Va^2/R$ watts, which is the same power as the ON nib. The nibs in the unselected nib sets will be powered by $[Va/(R+2R/((N/2)-1))/((N/2)-1)]^2(R)$ watts, which, as N gets large, becomes insignificant. If Phase B is grounded rather than remaining disconnected, the Phase B nib associated with S1 will receive no power. The remaining unselected nibs will be powered by $[Va/(2R)]^2 \times R$ watts, or, $Va^2/(4R)$ watts. This method establishes a 4 to 1 power ratio between selected and unselected nibs, a ratio that might be insufficient for high contrast printing.

Referring to FIG. 2, if Phase B is maintained at some other voltage, e.g. Vx, while Phase A is powered by Va, the power distribution can be altered. The selected nibs in all nib sets I–VIII of Phase A continue to be powered by $Va^2/R$ watts. The Phase B nibs associated with selected Phase A nibs will be powered by $Vx^2/R$ watts. The remaining unselected nibs in both Phases will be powered by $[(Va-Vx)/(2R)]^2 \times R$, or, $(Va-Vx)^2/(4R)$ watts. Thus, Vx can be used to lower the power dissipation in the unselected nibs at the expense of increasing the power dissipation in the Phase B nibs associated with selected Phase A nibs. The preferred overall power ratio is obtained when the two spurious responses are equal, that is, when $Vx^2/R=(VaVx)^2/(4R)$, or, $Vx=Va/3$. The use of $Vx=Va/3$ results in each unselected nib being powered by $Va^2/9R$ Watts. This 9 to 1 power ratio is sufficient for high contrast printing. This method is incorporated in the present invention.

Figure 3:
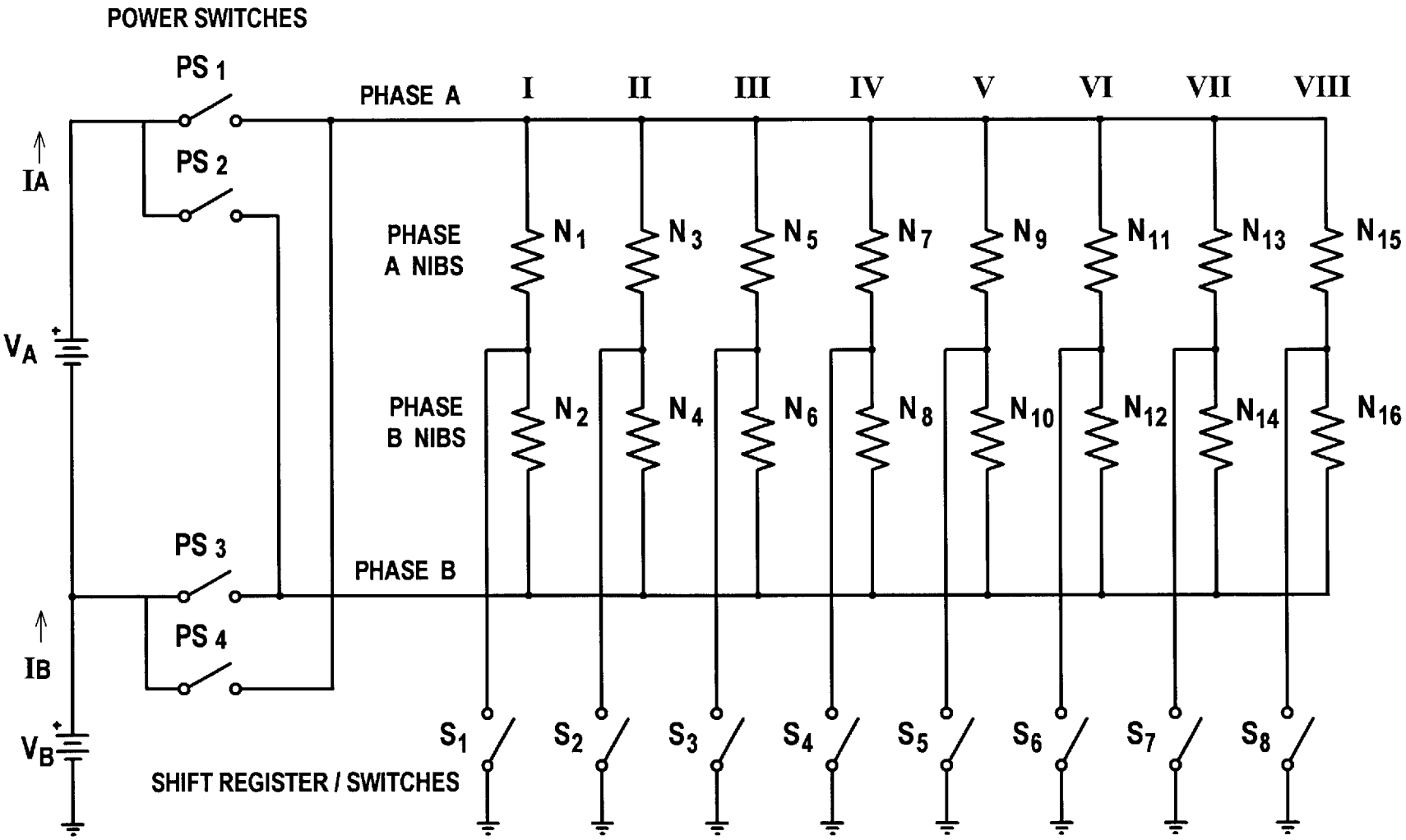
FIG. 3 is a schematic diagram of a TPH of the present invention, having two power sources and two phases.

FIG. 3 illustrates the preferred method of powering the diode-less TPH. Voltage V is the nominal TPH voltage, which is preferably the sum of Va+Vb, where Va=2Vb, or stated differently, Va=2V/3 and Vb=V/3. Power switches PS1–PS4 are preferably controlled as follows by a manner known in the art:

| | | | | | Phase A | Phase B |
|---|---|---|---|---|---|---|
| Condition | PS1 | PS2 | PS3 | PS4 | Voltage | Voltage |
| no power | off | off | off | off | 0 | 0 |
| Power Phase A | on | off | on | off | V | V/3 |
| Power Phase B | off | on | off | on | V/3 | V |

An expression can be derived for the currents IA and IB as follows: Let m be the fraction of the switches S1–S8 that are in the ON state. For example, if 2 of the 8 switches S1–S8 are ON, then m=0.25. When Phase A nibs are powered, then $IA=m\ (V/(2R/N))+(1-m)(2V/3)/(4R/N)$ and $IB=IA+m\ ((V/3)/(2R/N))-(1-m)\ (2V/3)/(4R/N)$.

All power switches PS1–PS4 are preferably capable of conducting current in the ON state, from left to right. Power switches PS3 and PS4 are preferably capable of conducting current right to left, as well. All power switches PS1–PS4 are preferably capable of blocking voltage in the OFF state, from left to right. Preferably, power switches PS3 and PS4 are capable of blocking voltage right to left, as well.

The Va (2V/3) power supply source preferably provides a worst case current for m=1 of $IAmax=V/(2R/N)$ amps and a worst case power of $PAmax=(2V^2/3)/(2R/N)$ watts. The Vb (V/3) power supply source preferably provides a worst case current for m=1 of $IBmax=IAmax+(V/3)/(2R/N)$ amps and a worst case power of $PBmax=(4V/9)/(2R/N)$.

The supply voltages Va and Vb may be taken from separate terminals on a single power supply, or may be supplied from separate power supplies.

Figure 4:
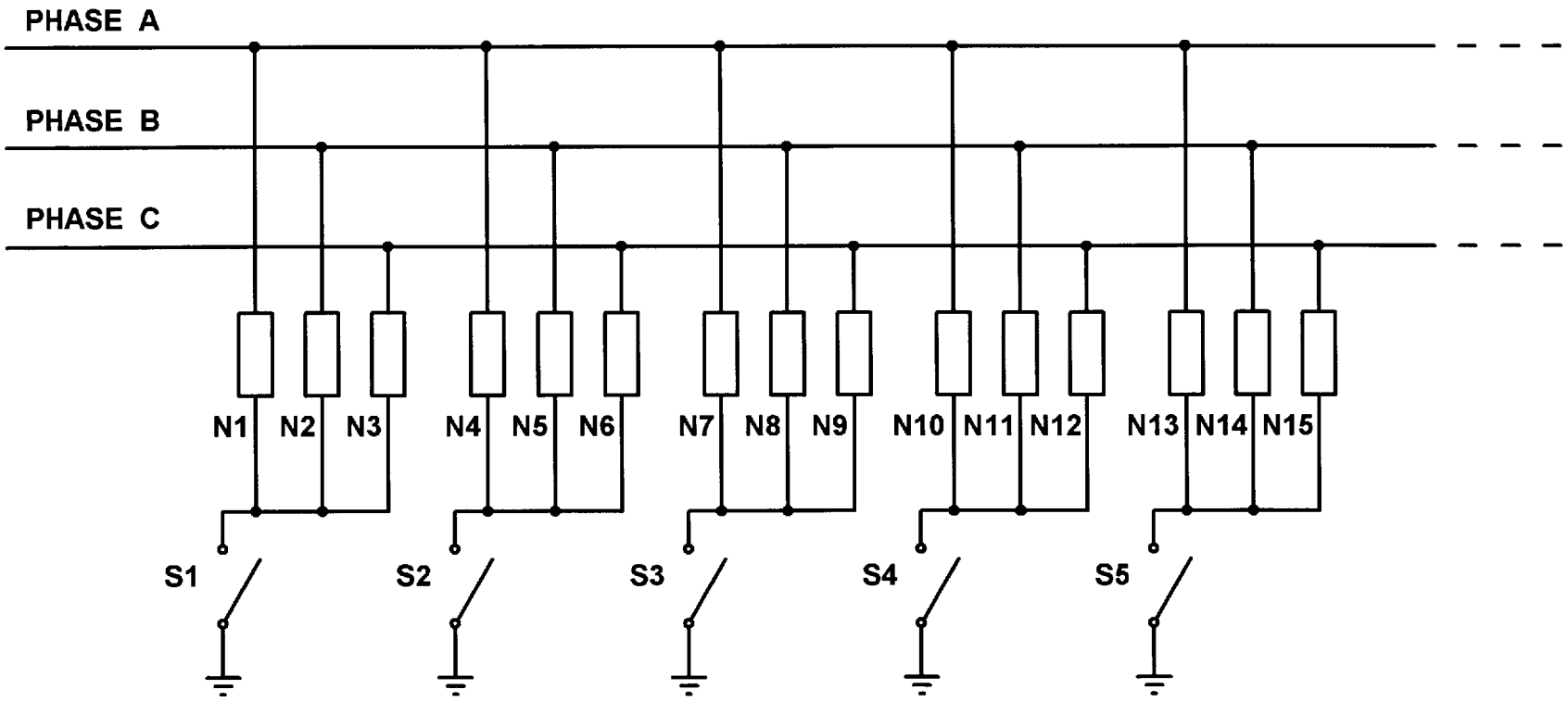
FIG. 4 is a schematic diagram of a TPH of the present invention having three phases.

In other embodiments, a TPH might have three or more phases, or groups, of nibs. Referring to FIG. 4, a TPH having three groups of nibs, Phases A, B and C, is depicted. In this three-phase example, the nibs, N1–N15, would be arranged in the TPH to form the pattern ABCABCABCA . . . . To power selected nibs in Phase A, V volts is applied to Phase A and Vx volts applied to Phases B and C. This can be generalized to more groups of nibs, such that the voltage V is applied to the selected phase and voltage Vx is applied to the unselected phases.

In FIG. 4, the selected nibs in Phase A dissipate V/R watts, as in the previous embodiments. The nibs in Phases B and C, associated with selected nibs in Phase A, dissipate $Vx^2/R$ watts, as in the previous embodiments. The unselected nibs in Phase A dissipate $[(V-Vx)/(R+(R/(N-1)))]^2 \times R$ watts, where N is the number of Phases, or groups, of nibs. The unselected nibs in Phases B and C dissipate $[(V-Vx)/NR]^2$ watts.

Since the power dissipation in the unselected nibs in Phases B and C of FIG. 4 is less than that in the unselected nibs in Phase A, the power dissipation in Phases B and C nibs can be ignored. Equating the remaining two spurious dissipations, gives: $Vx^2/R=[(V-Vx)/(R+(R/(N-1)))]^2 \times R$ watts, or, $Vx=V/(2+(1/(N-1)))$. Table 1 shows for various values of N, the resulting values for Vx and the power ratio between selected and unselected nibs. The worst case result is that for a large N, or Vx=V/2, a 4 to 1 power ratio results between selected and unselected nibs.

TABLE 1

| N | Vx | Power Ratio |
|---|---|---|
| 2 | V/3 | 9/1 |
| 3 | V/(2.5) | 6.25/1 |
| 4 | V/(2.33 . . . ) | 5.44 . . . /1 |
| 5 | V/(2.25) | 5.0625/1 |
| 6 | V/(2.2) | 484/1 |
| ∞ | V/2 | 4/1 |

The foregoing disclosure and description of the invention are illustrative and explanatory of the preferred embodiments, and changes in the components, circuit elements, or connections may be made without departing from the spirit of the invention.

What is claimed is:

1. A method of controlling printing by a thermal print head, comprising the steps of:

a. providing a plurality of groups of resistive-printing elements, wherein each said element has a first node and a second node, wherein said first nodes in each said group are connected together, and wherein each said second node is connected to one said second node in each of the other said groups;

b. providing a first voltage source, a second-voltage source, and an electrical ground;

c. connecting said first-voltage source to said first nodes of select said groups;

d. connecting said second-voltage source to remainder of said first nodes of said groups that are not selected in step c; and e. connecting select said second nodes to said electrical ground.

2. The method of controlling a printer of claim 1, wherein the magnitude of said first-voltage source is greater than the magnitude of said second-voltage source.

3. The method of controlling a printer of claim 1, wherein the magnitude of said first-voltage source is about three times greater than the magnitude of said second-voltage source.

4. The method of controlling a printer of claim 1, further comprising prior to step c the steps of:

f. providing a plurality of first-column-switches, each connected between said first nodes of one said group and said first-voltage source; and g. providing a plurality of second-column-switches, each connected between said first nodes of each said group and said second-voltage sources; and h. providing a plurality of row switches, each connected between one said second node and said electrical ground.

5. The method of controlling a printer of claim 4, wherein said row switches are current sinking devices.

6. The method of controlling a printer of claim 4, wherein said row switches are programmable.

7. The method of controlling a printer of claim 4, wherein each of said plurality of row switches has a control-input signal, and further comprising the step of:

i. providing a shift register having a plurality of output taps, wherein each said output tap is connected to one of said control-input signals.

8. The method of controlling a printer of claim 1, wherein the number of said groups is two.

9. The method of controlling a printer of claim 8, wherein said resistive-printing elements are formed in a single row, wherein each said resistive-printing elements is adjacent only to said resistive-printing elements of a different group.

10. The method of controlling a printer of claim 1, wherein the relationship of the magnitude of said first voltage source V, to the magnitude of said second voltage source Vx is determined by the equation $Vx=V/(2+(1/(N-1)))$, where N is the number of said groups.

11. A thermal print head, comprising:

a plurality of groups of resistive-printing elements, wherein each said element has a first node and a second node, wherein said first nodes in each said group are connected together, and wherein each said second node is connected to one said second node in each of the other said groups;

a plurality of first-column switches, wherein each said first-column switch is connected to said first nodes in one of said groups for connection of said first nodes of select groups to a first voltage source;

a plurality of second-column switches, wherein each said second-column-select switch is connected to said first nodes in one of said groups for connection of said first nodes of select groups to a second voltage source;

a plurality of row switches, wherein each said row switch is connected to one of said second nodes in each group, for connection of select said second nodes to electrical ground.

12. The thermal print head of claim 11, wherein said plurality of row switches are programmable.

13. The thermal print head of claim 11, wherein each said row switches includes a means for providing a control-input signal; and a shift register having a plurality of output taps;

wherein each said output tap receives one of said control-input signals.

14. The thermal print head of claim 11, wherein the magnitude of said first-voltage source is greater than the magnitude of said second-voltage source.

15. The thermal print head of claim 11, wherein the magnitude of said first-voltage source is about three times greater than the magnitude of said second-voltage source.

16. The thermal print head of claim 11, wherein the number if said groups is two.

17. The thermal print head of claim 16, wherein said resistive-printing elements are formed in a single row, wherein each said resistive-printing elements is adjacent only to said resistive-printing elements of a different group.

18. The thermal print head of claim 11, wherein the relationship of the magnitude of said first-voltage source V, to the magnitude of said second-voltage source Vx is determined by the equation $Vx=V/(2+(1(N-1)))$, where N is the number of said groups.

* * * * *

UNITED STATES PATENT AND TRADEMARK OFFICE

CERTIFICATE OF CORRECTION

PATENT NO. : 5,805,195
DATED : September 8, 1998
INVENTOR(S) : Smither, et al.

It is certified that error appears in the above-identified patent and that said Letters Patent is hereby corrected as shown below:

Column 3, line 54, delete "PBmax=(4V/9)/(2R/N)" and insert therefor -- PBmax=($4V^2$/9)/(2R/N) -- .

Column 4, line 1, delete "V/R" and insert therefor -- $V^2$/R -- .

Column 4, line 26, delete "484/1" and insert therefor -- 4.84/1 -- .

Signed and Sealed this

Second Day of February, 1999

*Attest:*

*Attesting Officer*

*Acting Commissioner of Patents and Trademarks*